US005222805A

United States Patent [19]

Schonbek et al.

[11] Patent Number: 5,222,805

[45] Date of Patent: Jun. 29, 1993

[54] PRECISION CHANDELIER FRAME

[75] Inventors: Andrew J. Schonbek; Georg Bayer; Arnold Schonbek, all of Plattsburgh; Daniel A. Tucker, Chazy, all of N.Y.

[73] Assignee: Schonbek Worldwide Lighting Inc., Plattsburgh, N.Y.

[21] Appl. No.: 813,431

[22] Filed: Dec. 24, 1991

Related U.S. Application Data

[63] Continuation-in-part of Ser. No. 539,854, Jun. 18, 1990, abandoned.

[51] Int. Cl.[5] ..... F21S 1/06

[52] U.S. Cl. ..... 362/405; 248/343

[58] Field of Search ..... 362/405, 406, 442; 248/222.3, 344, 343, 342

[56] References Cited

U.S. PATENT DOCUMENTS

| | | | |
|---|---|---|---|
| 1,032,660 | 7/1912 | Czerny | 362/405 X |
| 1,534,662 | 4/1925 | Riddle | 362/405 |
| 1,644,452 | 10/1927 | Spencer | 362/408 |
| 1,668,772 | 5/1928 | Kestell | 362/405 |
| 2,437,350 | 3/1948 | Ferlin et al. | 362/241 |
| 3,530,289 | 9/1970 | Friedman et al. | 362/332 |
| 4,107,770 | 8/1978 | Weber | 362/405 |

FOREIGN PATENT DOCUMENTS 2445486 12/1978 France .

*Primary Examiner*—Stephen F. Husar

*Attorney, Agent, or Firm*—Wolf, Greenfield & Sacks

[57] ABSTRACT

A chandelier frame made from rings and spokes is provided. The rings are adapted for supporting ornaments, and the spokes are attached to the rings for supporting the rings, preferably coaxially. The rings and spokes are attached to one another by interengaging locking means which mechanically and detachably secure the rings and spokes to one another. The rings and spokes may be formed entirely from nonstressed metal, and most preferably are cut from flat sheet metal.

29 Claims, 15 Drawing Sheets

PRECISION CHANDELIER FRAME

This application is a continuation-in-part of U.S. Ser. No. 07/539,854 filed Jun. 18, 1990 and entitled PRECISION CHANDELIER FRAME, now abandoned, entire disclosure of which is incorporated herein by reference.

This invention relates generally to chandelier frames and, in particular, to chandelier frames adapted for supporting ornaments such as crystals in a precise array with respect to one another and with respect to a light source.

BACKGROUND OF THE INVENTION

The art of making chandelier frames has varied only slightly in the past hundred years. Most chandelier frames include a plurality of hoops of varying diameter arranged coaxially and adapted for supporting ornaments such as crystals. The hoops are supported by spokes. According to typical prior art constructions, the hoops are formed from straight pieces of metal which are bent into the form of rings and welded together at their free ends. The spokes also are formed typically from straight pieces of metal bent and welded to one another. Prior art chandelier frames further typically have portions held together by screws, rivets, eyelets and the like.

Where complex chandelier frames such as those described herein are concerned, the prior art methods of manufacture may involve well over a hundred discrete bending and attachment operations and may require numerous work stations. The labor and organization required to make a variety of such chandeliers is extraordinary.

A prior art chandelier frame shown in FIGS. 1 and 2 is similar in function to a chandelier according to the invention shown in FIG. 3. Its parts are made of stressed (bent) metal and held together by welds. The prior art chandelier frame has a center post 10 to which is attached upper, middle and lower hoops, 12, 13 and 14 respectively. The hoops 12, 13, 14 may be bent from straight stock such as rod, flat or tube stock into a circular shape that is welded at joints, 16 and 18 respectively, to permanently join each hoop's free ends. The hoops may be die cut (hoop 13). The stressed hoops are attached, at points 20 and 22 to a series of upright spokes 24 and radially extending spokes 26. These spokes 24, 26 also are bent at various places. The spokes 24, 26 are welded to each other. This welded collection of parts is secured centrally by welds to a center washer 28 disposed about the center post 10.

The bending of hoops and spokes introduces imprecisions into the frame. A stressed hoop usually is far from symmetrical both radially and axially. When combined with all the welding required, the misalignment and imprecision of each frame is substantial. This lack of symmetry has a substantial effect on the overall appearance of the finished chandelier in that crystal ornaments are not precisely located with respect to one another, thereby diminishing the overall appearance of the chandelier. Additionally, no easy means of alignment of all the pieces to prepare them for welding is possible with the prior art frame. Moreover, welds often are imperfect and the hoops and spokes may come apart. These and other drawbacks are overcome by the chandelier frames of the invention.

SUMMARY OF THE INVENTION

The invention involves a novel method for manufacturing, aligning and mechanically interengaging the component parts of a chandelier frame. The chandelier frames made according to the invention have a symmetry, both radially and axially, that is far superior to the prior art. The chandelier frames of the invention are easy to manufacture, and do not involve welds, rivets, screws, eyelets and the like for the interengagement of their component parts. The frames also may be easily disassembled for repair or for replacing parts.

According to the invention, a chandelier frame made from rings and spokes is provided. The rings are adapted for supporting ornaments, and the spokes are attached to the rings for supporting the rings, preferably coaxially. The rings and spokes are attached to one another by interengaging locking means which mechanically and detachably secure the rings and spokes to one another. The rings and spokes may be formed entirely from nonstressed metal, and most preferably are cut from flat sheet metal.

Preferably, the rings and spokes are held together by interlocking tabs and slots, the tabs and slots being preformed and located at discrete positions to precisely align the rings and spokes with respect to one another. Most preferably, the tabs include a head and a neck, the neck having a narrower diameter than the head. The tabs may be located on a plurality of arm segments integral with and extending from a main segment of the spokes and defining platforms for seating the rings. In a most preferred embodiment, at least a portion of one of the slots and tabs is cut using a laser.

According to another aspect of the invention, the spokes are aligned and attached mechanically to a centrally located plate, preferably by interlocking tabs and slots. That plate may form a portion of a centerpiece such as a light box, which itself may be manufactured from flat material joined together by interlocking tabs and slots.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENTS

Figure 1:
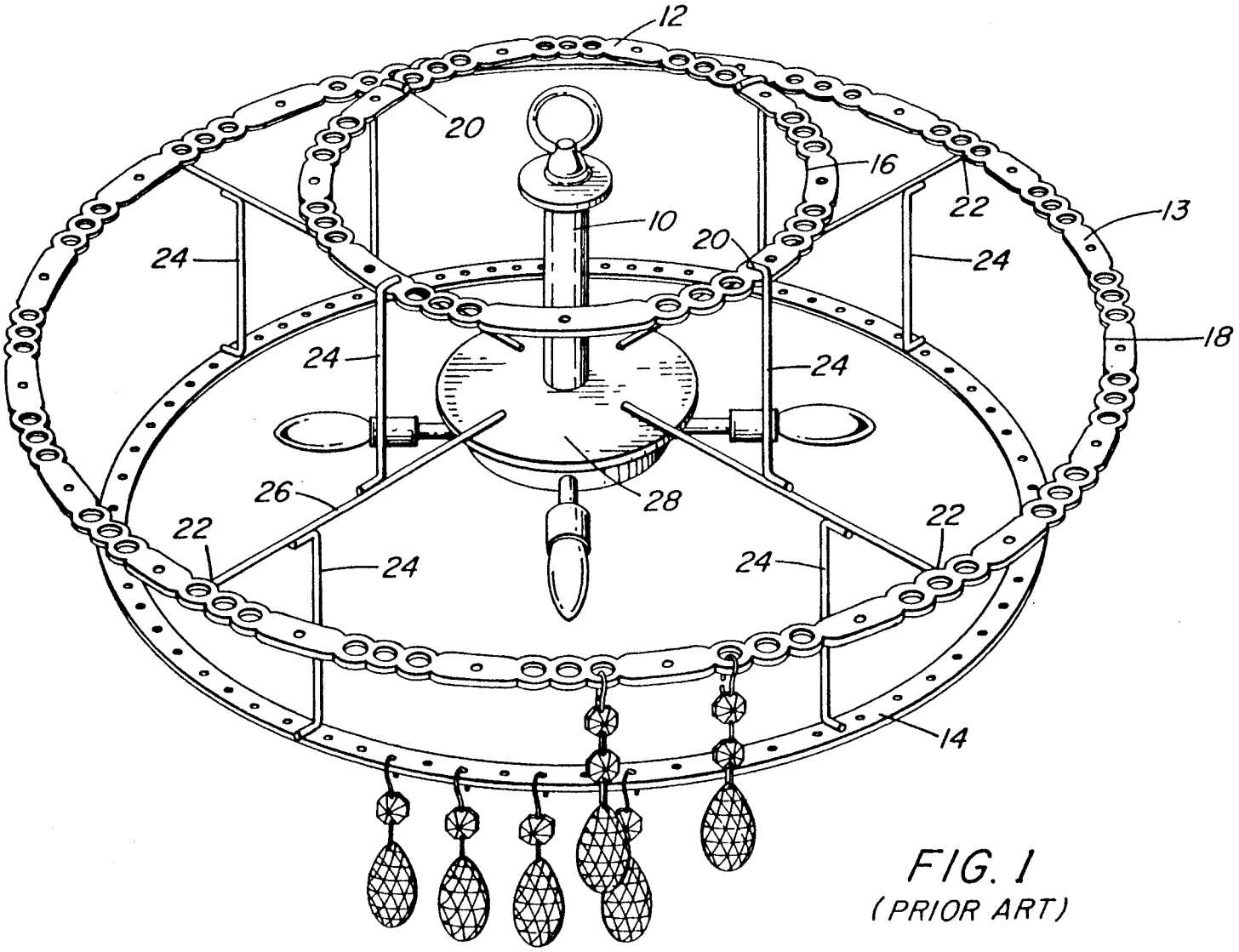
FIG. 1 (PRIOR ART)
FIG. 1 is a perspective view of a prior art chandelier frame having stressed hoops and spokes welded to one another.
Figure 2:
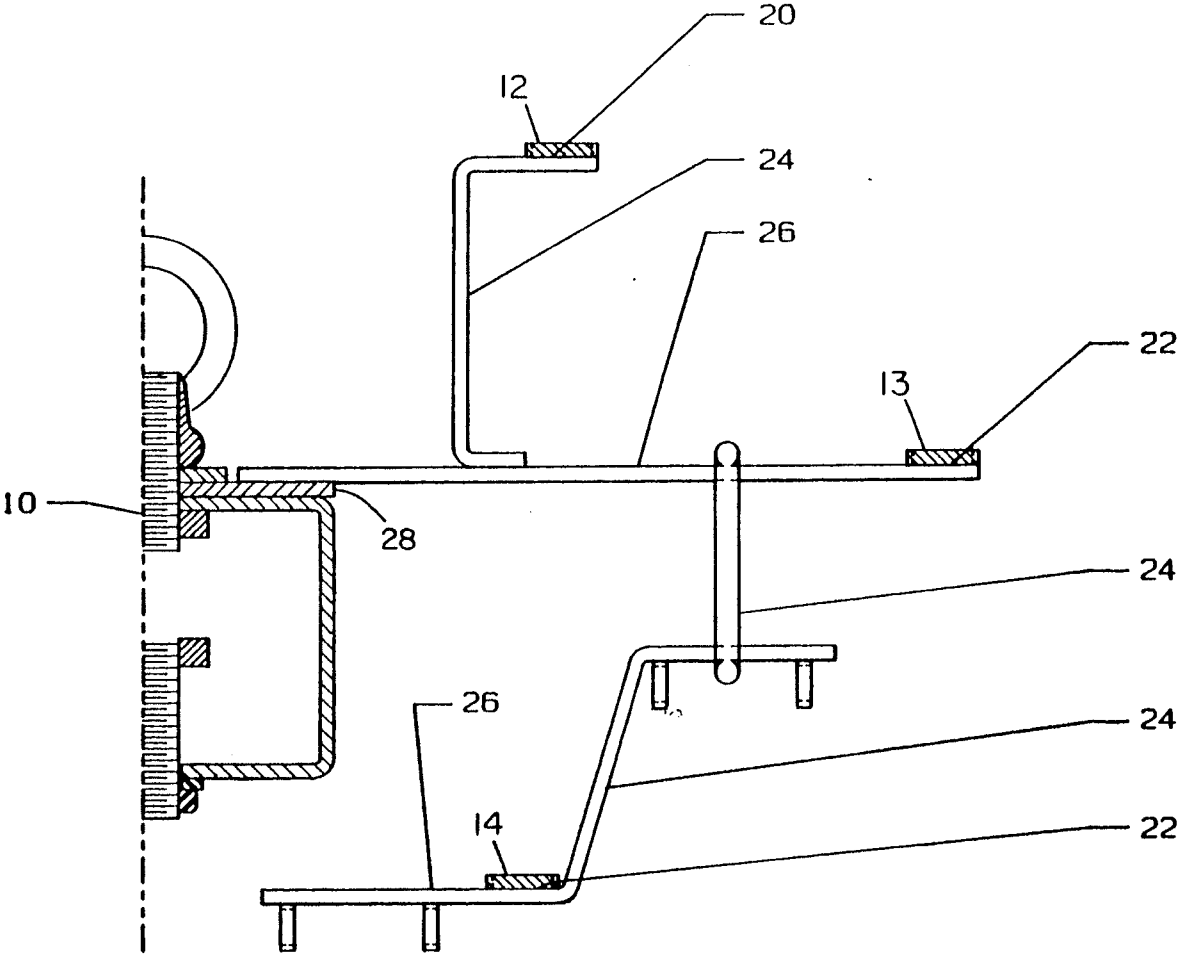
FIG. 2 (PRIOR ART)
FIG. 2 is a partial cross-sectional side view of the prior art chandelier frame of FIG. 1.
Figure 3:
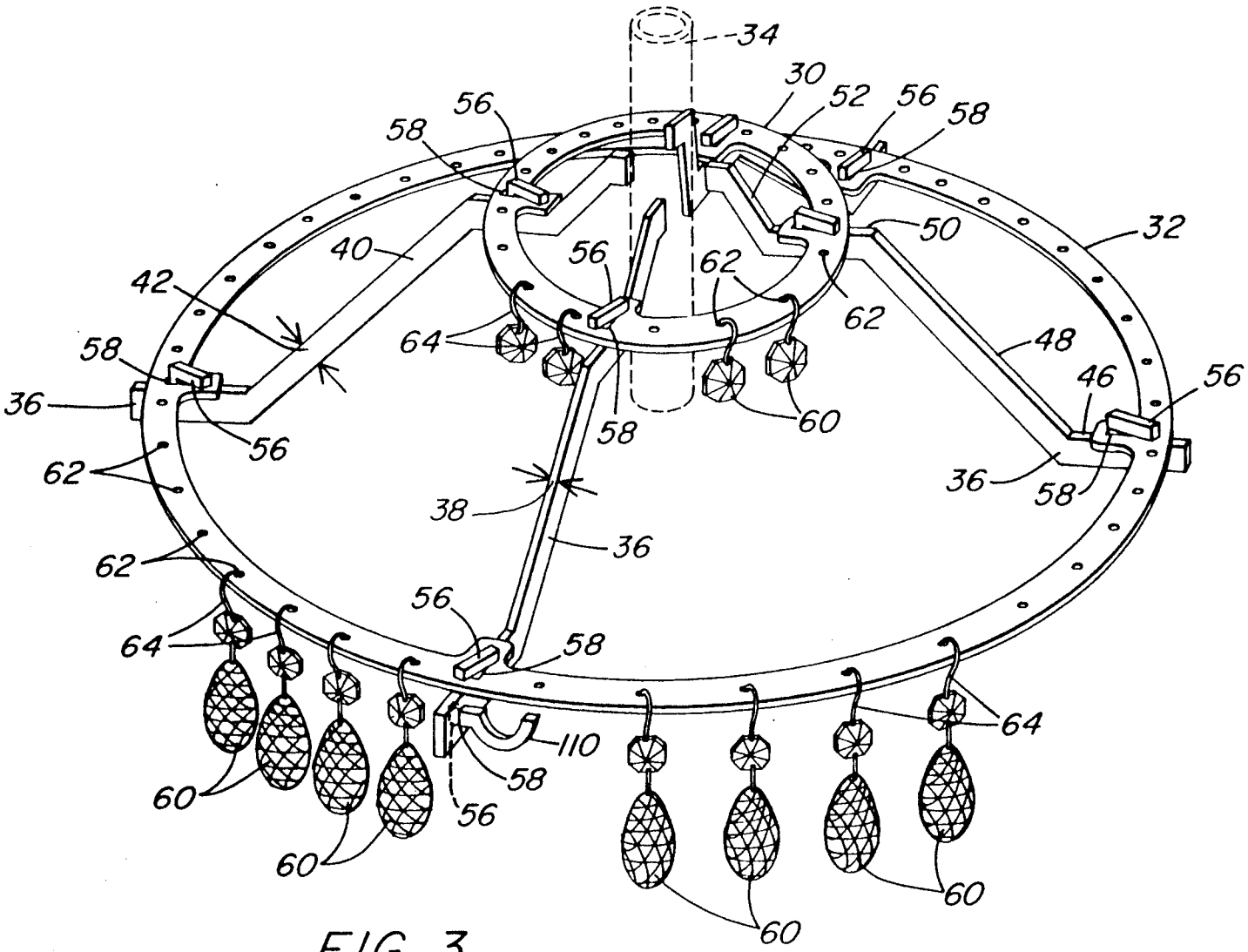
FIG. 3 is a perspective view of a chandelier frame constructed according to this invention.

A chandelier frame is shown in a preferred embodiment in FIG. 3 which illustrates multiple aspects of the invention. The depicted chandelier frame may be manufactured from flat, nonstressed sheet material without the use of welds, eyelets, screws or rivets to join any of the parts together. As described further below, the use of non-stressed parts, cut precisely, aligned and assembled without the use of bending, welds or other deforming processes, results in a superior product. High structural tolerances are possible that significantly enhance the optical effects obtainable with a chandelier built in this manner. This product is also easy to assemble.

The embodiment depicted in FIG. 3 utilizes coaxial upper and lower rings, 30 and 32 respectively, disposed about and relative to a center piece 34 shown in phantom. The rings are aligned and separated from each other by attachment to a set of spokes 36 radially positioned relative to the center piece 34.

Due to the novel alignment and attachment arrangement of the invention, the pieces of the chandelier frame of FIG. 3 may be cut from flat sheet material. They remain substantially nonstressed in final assembled form with no bending required to place them into the proper configuration. This is a significant distinction over the prior art.

The spokes 36 and rings 30, 32 of the embodiment depicted in FIG. 3 define a thickness 38 transverse to their flat surfaces 40. The thickness 38 is substantially less than the width 42 of the flat surfaces. As such, each piece tends to define a plane, the rings defining parallel planes and the spokes defining planes substantially perpendicular to these parallel planes. The plane of the spokes is generally oriented vertically in use, contributing to the strength of the frame.

The edge of the spokes 36 transverse to the flat surfaces 40 and facing the rings 30, 32 define nonlinear segments 46, 48, 50 and 52 (i.e., the straight segments meet one another at angles). Two of these segments 46 and 50 define parallel platforms that support a flat side of the upper and lower rings 30, 32, respectively. These platforms, thus, make possible the integral combination of both spacing the rings 30, 32 axially along the center piece 34 and aligning the rings 30, 32 coaxially with respect to the center piece 34.

The platforms 46, 50 preferably include tabs 56 extending from the platform and engaging integrally formed through-cut slots 58 cut at predetermined locations in the rings 30, 32. The tabs 56 and slots 58 allow for positive mechanical interengagement of the rings 30, 32 and the spokes 36. The tabs 56 and slots 58 also precisely align the rings 30, 32 radially relative to one another and to the spokes 36. Through this interengagement, the rings then are secured in position against rotation about the center piece 34 and displacement radially relative to the center piece 34. As such, ornaments 60 depending from different rings (which ornaments are located through preformed holes 62 by means of hooks 64) maintain a precise alignment with respect to one another for an enhanced optical effect. Such precise alignment of ornaments of different rings was unachievable according to prior art chandelier frame constructions.

The mechanical interengagement of the tabs and slots allows a chandelier frame to be quickly assembled without the use of any welding, adhesives, screws or rivets. The tabs are of a unique design having close tolerances and, thus, are particularly well suited to cutting techniques including laser cutting. The tabs may be cut simultaneously and be formed integrally with the overall cutting of the chandelier part.

Figure 4:
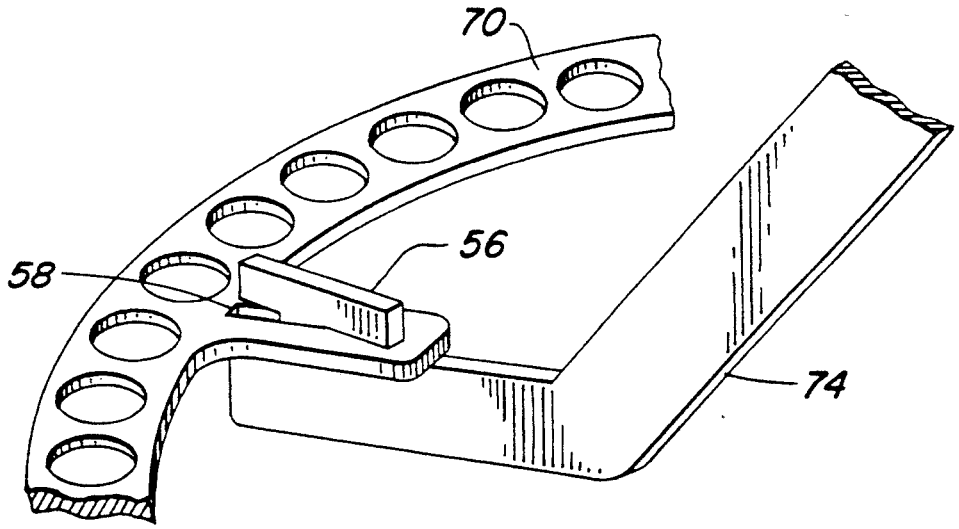
FIG. 4 is a more detailed perspective view of a spoke and ring of the chandelier of FIG. 3, showing an interengaging tab and slot.
Figure 5:
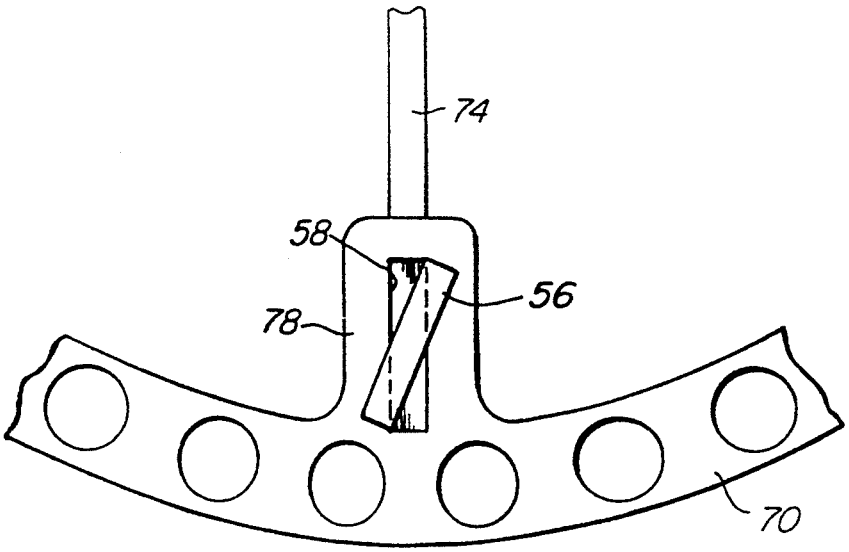
FIG. 5 is a top view of a tab and slot as shown in FIG. 4 showing the tab twisted to lock the slotted part to the tabbed part.

A more detailed view of the mechanical interengagement of a spoke and ring via a preferred tab and slot arrangement is depicted in FIG. 4. A portion of a ring 70 is shown resting in face to face relation upon a platform of a spoke 74. The spoke 74 has an integrally formed tab 56 projecting through a slot 58 in the ring 70. The tab 56 may be twisted to provide positive locking interengagement of the ring 70 and spoke 74. This configuration is depicted in FIG. 5 in which the upper portion of the tab 56 is twisted out of alignment with the slot 58 to contact the surfaces 78 of the ring 70 on opposing sides of the slot. The twist is accomplished primarily by deforming the narrow tab neck. This is the only stressing of the parts that is required. Thus, the structure is "substantially nonstressed". Since the deformation occurs at only small isolated points upon the chandelier frame where radial alignment of the rings relative to each other and to the center axis is fixed, the structural tolerance of the chandelier frame remains extremely high (less than 3/64 inch radial and axial tolerance). Additionally, the speed at which the tabs may be twisted allows for quick and simple assembly.

Figure 6:
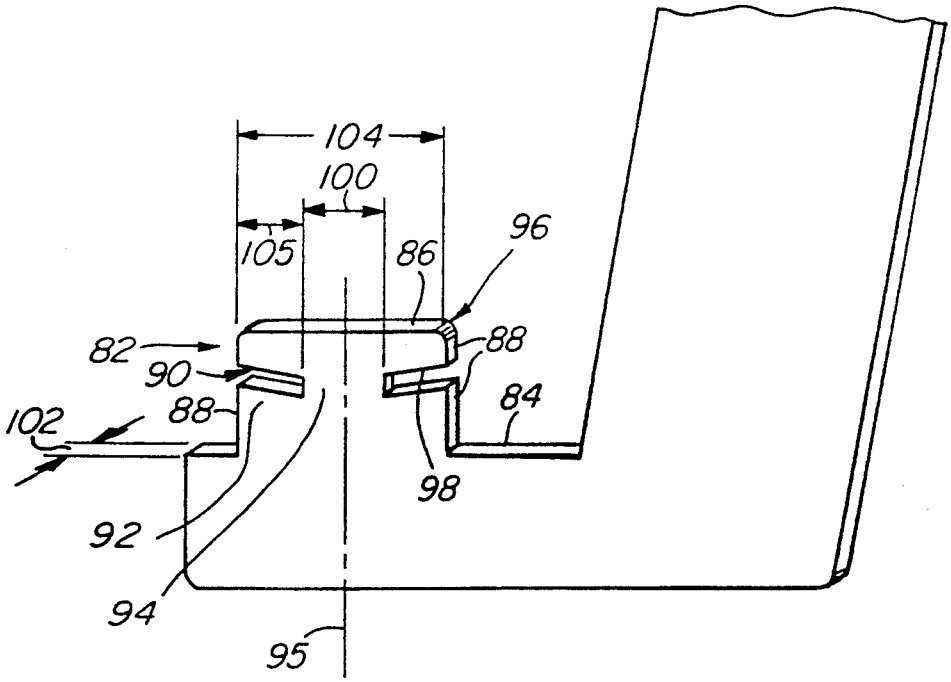
FIG. 6 is a more detailed perspective view of a twist tab according to this invention.

The details of a preferred tab are depicted in FIG. 6. The tab is constructed from a generally rectangular projection 82 formed integrally with a spoke and extending from a platform 84 for supporting a ring (not shown). Since die cuts generally are more precise than laser cuts, it is preferred that the tab and platfrom immediately adjacent the tab and forming the seat for the ring are die cut rather than laser cut. This will insure a snug fit between the tab and the ring slot and ensure proper seating of the ring on the platform.

The rectangular projection is defined by a top wall 86 and two side walls 88 extending from the top wall 86 to the platform 84. A pair of thin slots 90 are cut (preferably by a laser) into opposing side walls 88. The slots 90 extend toward one another and downwardly toward the platform 84, but stop short of meeting one another so as to divide the rectangular projection into three portions, a seat 92 adjacent the platform 84, a narrowed neck 94 at the convergence of the slots 90 and a head 96 located above the slots 90. The head 96 may be gripped, preferably with a tool, and twisted about the narrow neck 94 along axis 95 passing centrally of the tab (in the direction of the tab passing through the slot) to bring the head 96 out of planar alignment with respect to the seat 92.

In use, a slotted part such as a ring is positioned on the platform 84 of, for example, a spoke, with a the tab extending through the slot. The seat 92 of the tab is sized to fit snugly within the ring slot so as to precisely align the ring and spoke and to prevent any significant lateral movement of the ring with respect to the spoke. The slots 92 on the tab are sized with respect to the ring such that they converge and form the neck 94 at a position within the ring slot when the ring is seated on the platform. The downwardly facing surfaces 98 of the head 96 likewise extend into the ring slot when the ring is seated on the platform. As such, when the tab head 96 is twisted, the downwardly facing surfaces 98 of the head 96 engage surfaces of the ring adjacent the slot and ensure a tight interlock between the ring and spoke. Motion in all degrees of freedom is prevented. In the embodiment shown, the tab slots 90 are straight. It should be understood, however, that other configurations, including slots defining a radius may be used, and may even be preferred.

Figure 9:
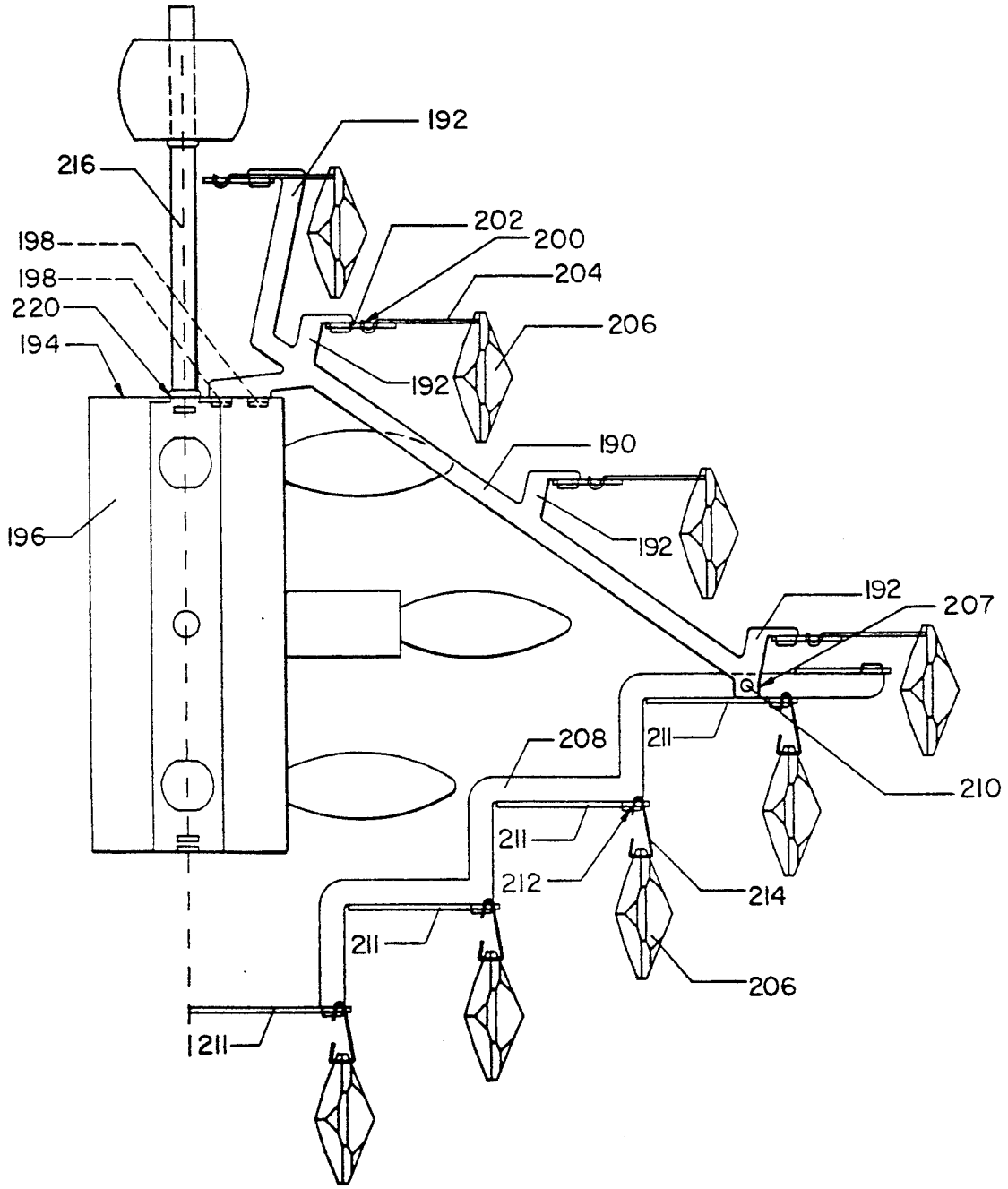
FIG. 9 is a partial side view of a chandelier frame constructed from spokes and rings of FIGS. 7 and 8.
Figure 10:
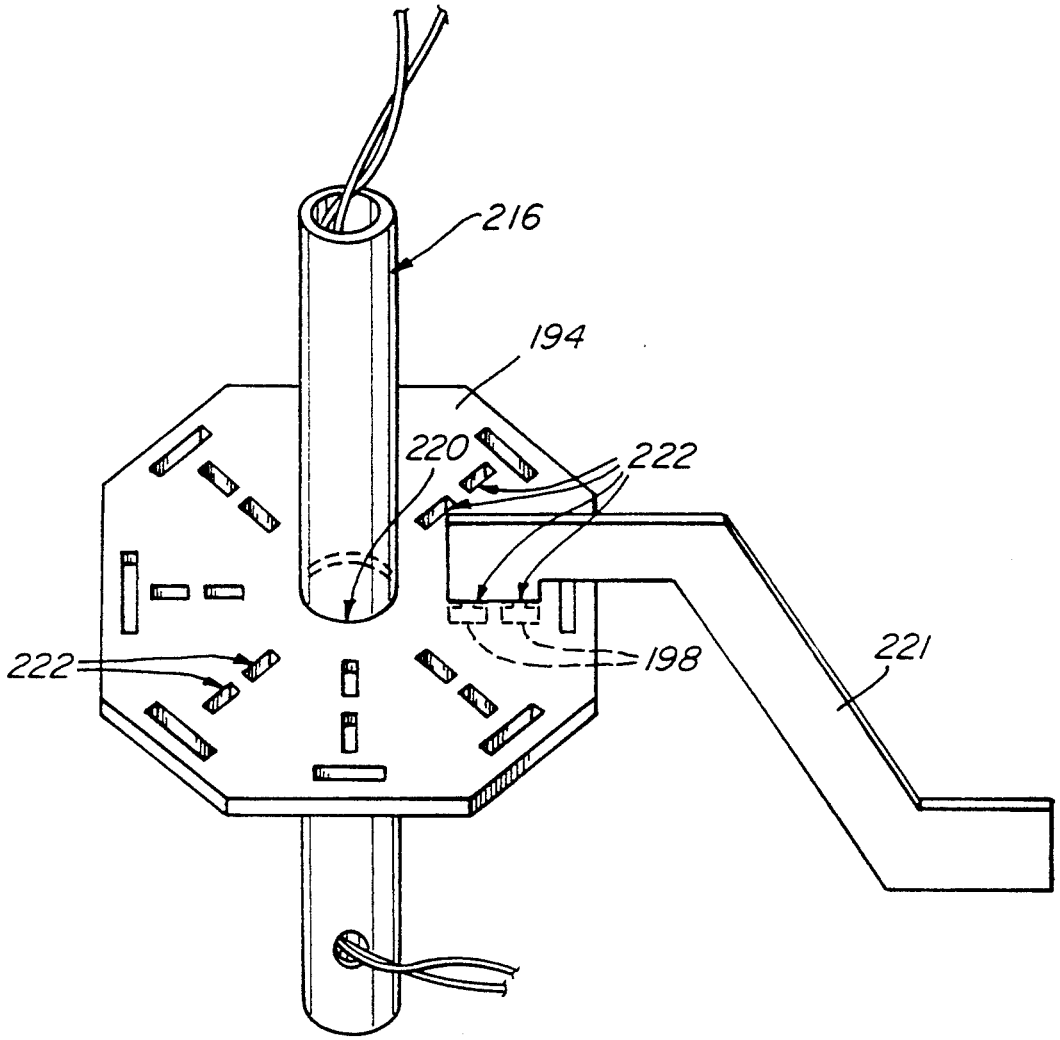
FIG. 10 is a perspective view detailing the attachment of a spoke to the top plate of a center piece used in the chandelier of FIG. 9.
Figure 14:
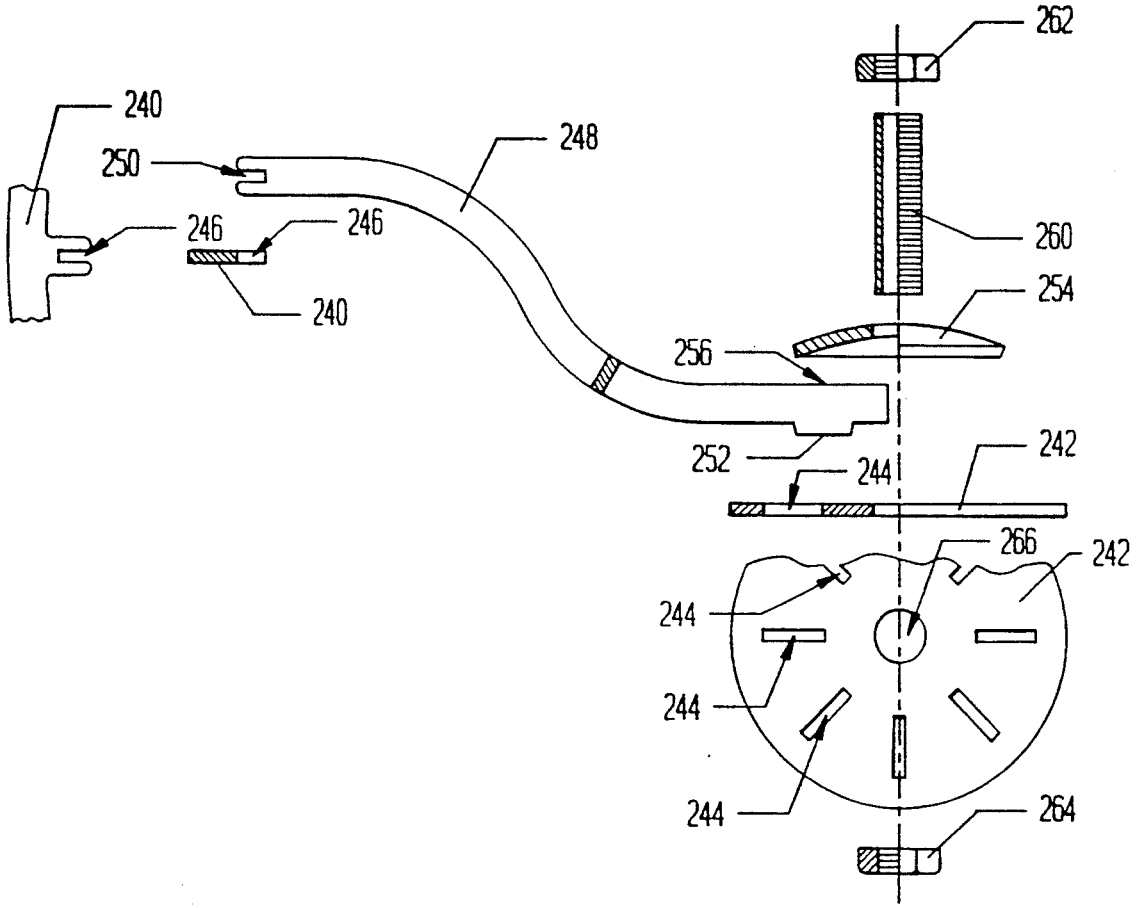
FIG. 14 is a side view of an alternative structure for mechanically interlocking the rings and spokes of a chandelier frame.

The tab and slot interengagement also can be used in connection with securing spokes to plates, as in FIGS. 9, 10, or in securing spokes to center rings such as in FIG. 14. It further should be understood that the ornament bearing aspect of the chandelier may the spoke rather than the ring. In particular, the rings, for example, may be disposed internally of the spokes which may be scrolled for an esthetically appealing appearance. (See FIGS. 17 and 18).

In a preferred embodiment, for effective locking, the neck width 100 is 1.7 times the spoke thickness 102, and the distance 105 from a sidewall 88 to the neck is 1.25 the spoke thickness. Similarly, the head width 104 is at least 4.2 times the spoke thickness 102. In one successful embodiment according to the invention, the sheet metal from which the spokes and rings were cut was a close tolerance, cold-rolled, steel sheet, flat roll and full hard, 14 gage thickness (0.074 inches, ±0.002 thickness tolerance), obtained from Lapham Hickey, Chicago, Ill., under the trade designation C-1010 alloy. The neck width was about 0.125 inches, and the head width was about 0.3 inches. The slots forming the tab neck and head were 0.007" in thickness and converged at an angle of nine degrees relative to the platform. These slots were cut using a laser. The slots converged at the neck which was located 0.005" below the surface of the ring when the ring was seated on the platform. The ring slots which received the tabs were die cut to provide a clearance of 0.005 about the tabs.

The positive locking arrangement described above also makes possible the suspension of a slotted part in any orientation. Thus, a spoke may contain a tab and platform upon its downward facing side with a ring hanging from the spoke, having its weight supported only by the tab.

The use of the preferred tab and slot interengagement system is not limited solely to rings and spokes. As depicted in FIG. 3, the chandelier frame may have a slot disposed upon, for example, a spoke 36. Another part such as a hook, having a tabbed projection may be attached to the slot on the spoke. In FIG. 3, a planar hook 110 cut from nonstressed sheet material and having a tab 56 shown in phantom is attached to a slot located at the lower extremity of spoke 40. This hook 110 may be used for hanging a second tier or "basket" of rings, or for other purposes.

It should be noted that other systems for securing the chandelier frame parts together are possible and may be required for nonmetallic or soft metal parts. Spokes and rings may be interengaged by a snap fit, in which one of the parts is forced into an interfering fit with another. Additionally, parts may be cut with opposing grooves that intermesh and maintain the parts in alignment with respect to each other and a central axis. These methods may involve the use of some welding, adhesives, or other techniques of joinery with, however, the significant advantage over the prior art in that the perpendicularly oriented planar construction and use of interengaging slots or tabs and slots allows frame alignment to be predefined and maintained during a final joining process. Examples of other mechanical attachments are described in greater detail in connection with FIGS. 14–15 below.

Figure 7A:
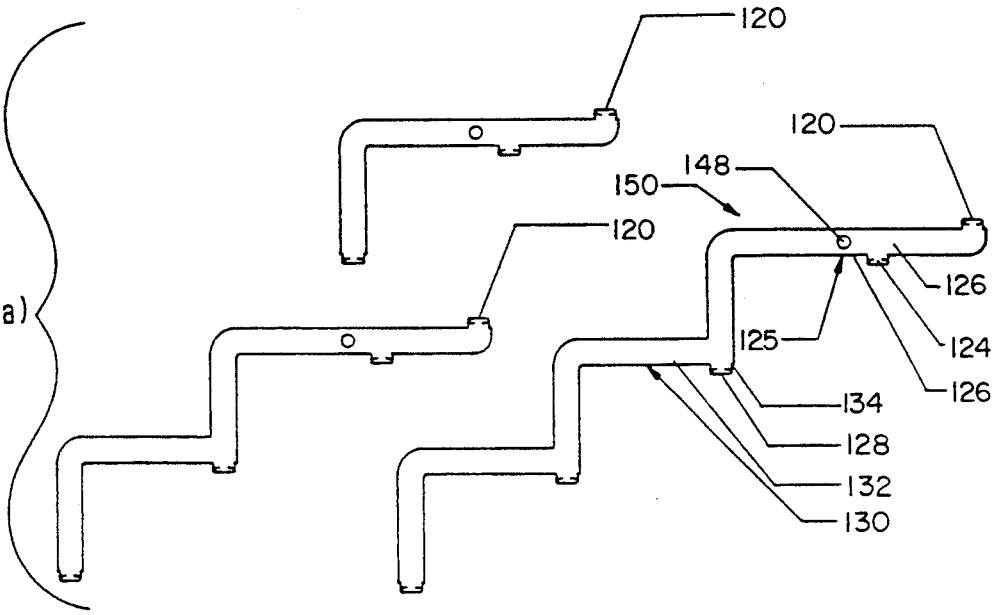
FIG. 7(*a–b*) are side views of various spokes having tabs disposed upon segments for interengaging rings and center pieces.
Figure 7B:
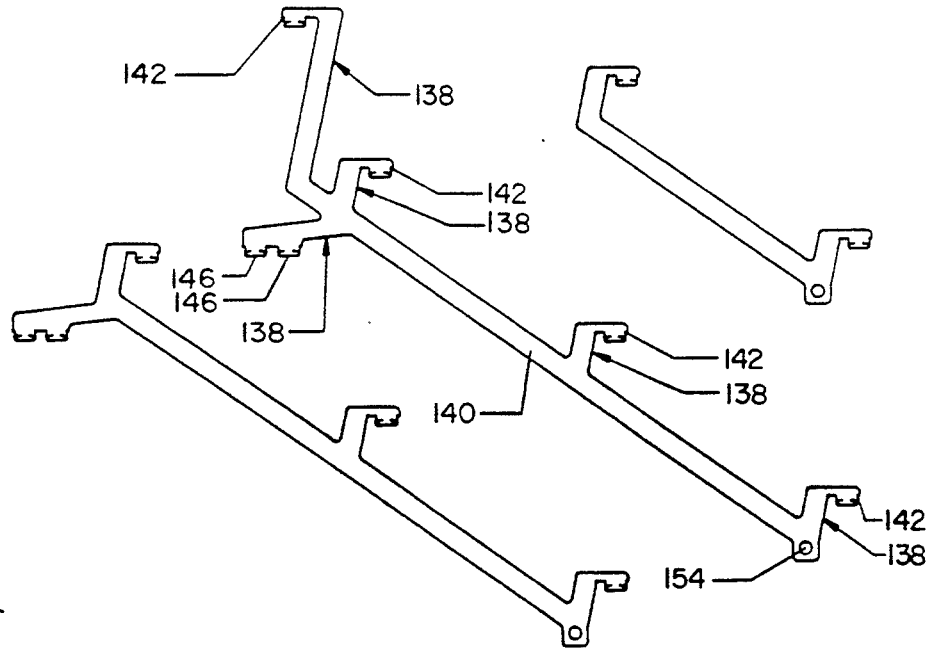

Spokes may be constructed elaborately to support a multiplicity of coaxial, axially separated, rings. One type of spoke utilizing the twisting tab concept is shown in FIG. 7(*a*). The spokes depicted contain upward facing tabs 120 for mounting to a center unit. They have downwardly facing tabs for supporting rings. A tab such as tab 124 is located along a segment 125 of the spoke such that a large length 126 of segment 125 is disposed on either side of the tab 124. Another tab 128 is in close proximity to an end of segment 130, with a substantial length of segment 132 on one side of the tab 128 and with only a short length 134 on the other side, the short length being sufficient in order to provide an adequate platform for the ring.

A second type of spoke, depicted in FIG. 7(*b*), has supporting arms 138 extending from a main segment 140 and defining arm platforms 142 from which rings hang with their weight supported by the tabs. The spokes of FIG. 7(*b*) may include a pair of tabs 146 disposed upon one of the arms 138 for attachment to a center unit. The use of two tabs helps to provide extra strength when attached to a center unit (which has two corresponding slots). A spoke also may be provided with a hole 154 disposed at one end of the spoke. This hole may be used, for example, to join the spoke, by means of a fastener, to the hole of another spoke, such as hole 148 of the spoke 150 shown in FIG. 7(*a*).

Figure 8:
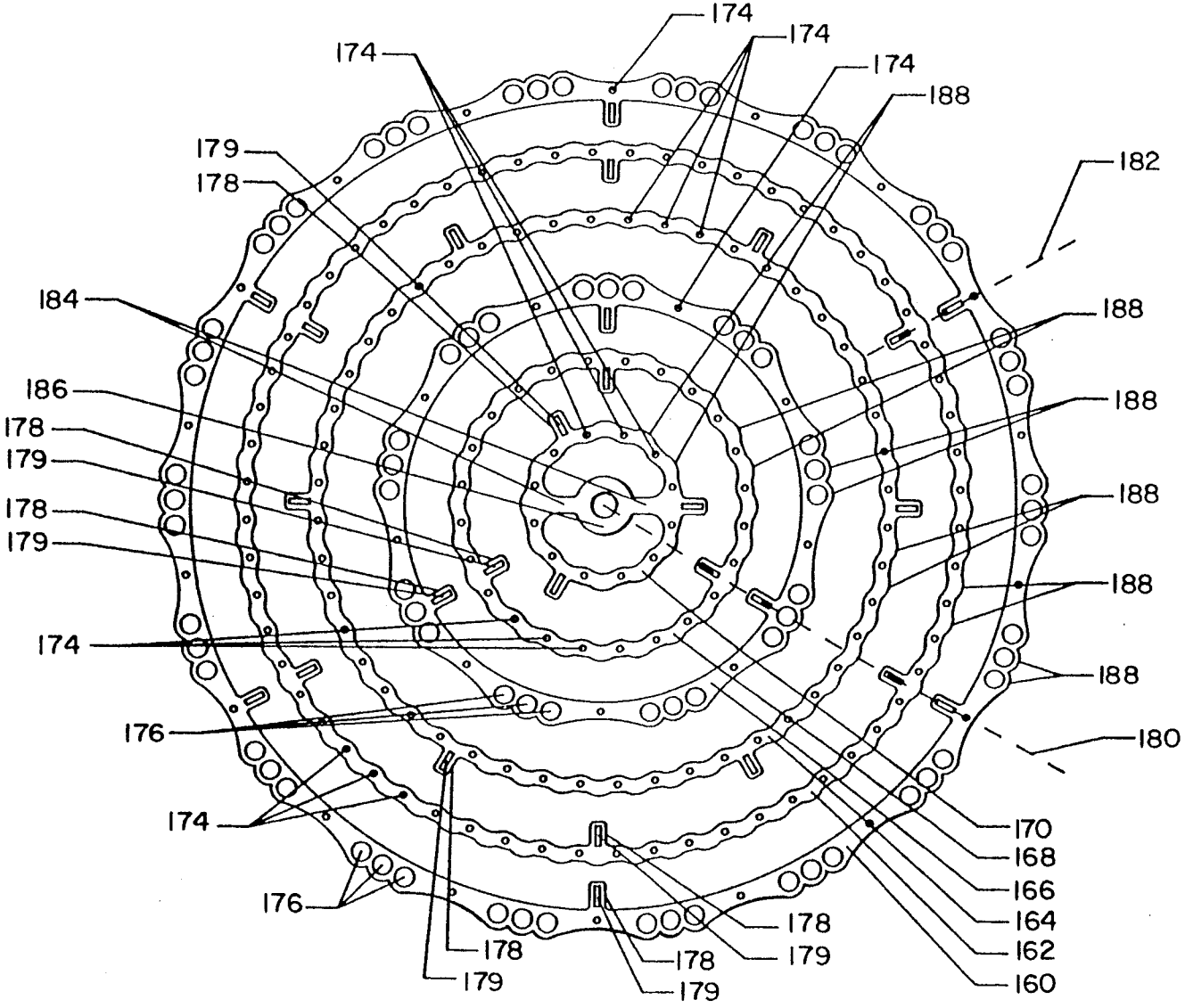
FIG. 8 is a top view of a series of concentric rings having elaborate edge details for use with the spokes of FIG. 7.

Elaborate rings may be formed to construct a chandelier frame according to this invention, particularly if laser cutting is utilized. Shapes varying from an ordinary annulus having a variety of holes, slots and edge contours are possible. FIG. 8, for example, depicts a series of six slotted rings 160, 162, 164, 166, 168 and 170, concentric about a central axis. Each of these rings contains a series of small holes 174 for hanging ornaments from hooks, as well as certain large holes 176, as shown upon the outermost ring 160, through which ornaments such as crystal rods may be suspended. Each of the rings contains, evenly spaced about its perimeter, a series of projections 178 having slots 179 cut therethrough at precise locations. The slots 179 may accept the mechanically interengaging tabs described above. The precise alignment of the slots 179 and ornament mounting holes 174, 176 between two or more rings in the assembled frame achieves symmetrical crystal placement to a degree never before achieved.

Each of these rings may be spaced axially relative to the other rings by attachment to spokes such as those shown in FIGS. 7(*a*) and 7(*b*). Certain rings 160, 162, 166 and 168 have slots disposed in radial alignment (dotted line 180) relative to each other while other rings 164 and 170 are radially aligned (dotted line 182) offset to the other radially aligned slots. This allows certain spokes to support some of the rings while other spokes carry other rings, thus preventing overloading of spokes and making possible very large groupings of axially spaced rings.

Figure 12:
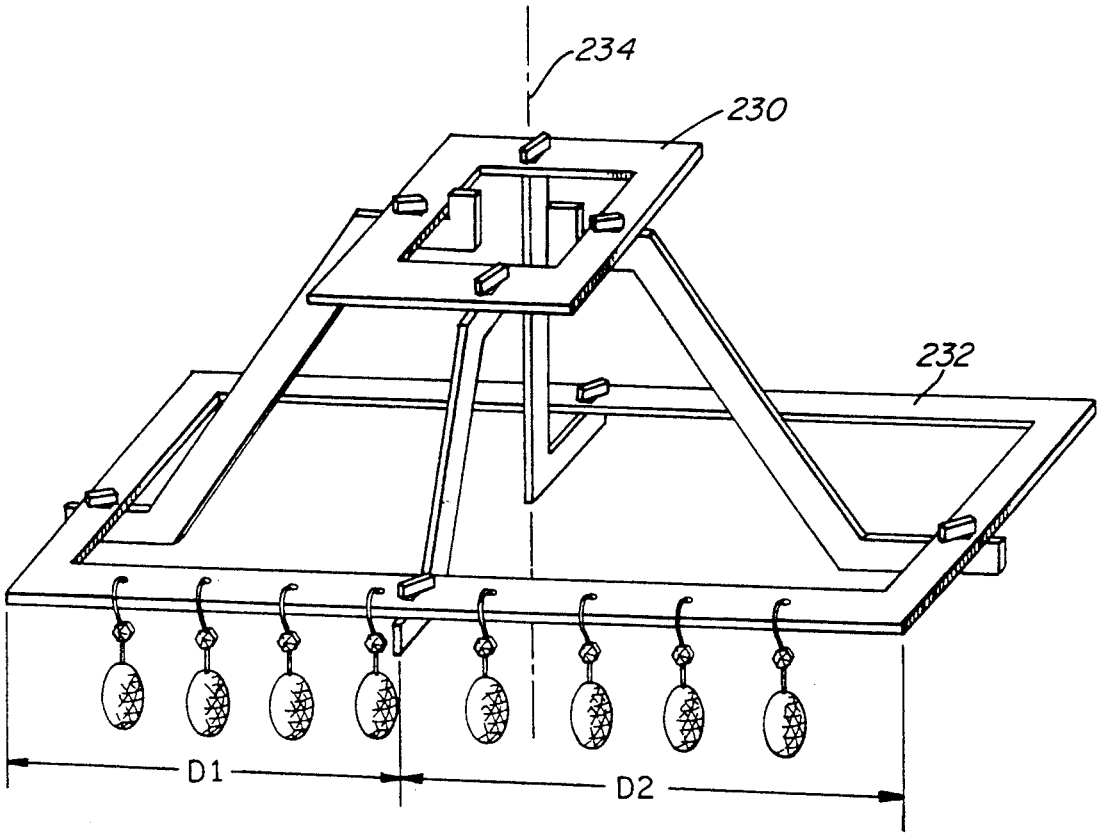
FIG. 12 is a perspective view of an obliquely-constructed, noncircular chandelier frame according to this invention.

The rings may take various forms, and broadly may be defined as a plate having an opening. The particular configuration will be selected based upon both functional and aesthetic considerations. As exemplified by the inner projecting arms 184 and annular center 186 of the innermost ring 170, rings may include shapes that extend outside of the general radial boundaries defined by the ring. Similarly, a ring does not have to scribe a circular path, as shown by the irregular undulating outer surface contour 188 upon each ring. In fact, as depicted in FIG. 12, rings need not be circular at all. Rather, oblique and noncurved shapes 230 and 232 may be utilized as chandelier frame rings. The central axis 234 for such a shape also need not be the centroid of each ring (note that D1 is less than D2).

The elaborate spokes and rings of FIGS. 7(*a*), 7(*b*) and 8 may be combined to form an equally elaborate tab and slot type of chandelier shown generally in partial side view in FIG. 9. The upper spoke 190 having four supporting arms 192 defines an upper portion of the chandelier frame with coaxial rings that increase in diameter from top to bottom. The spoke 190 is mounted to the top plate 194 of a center piece 196 by means of a pair of tabs 198 that positively secure it. Ornaments are attached to the rings of this upper spoke 190 through holes 200 in, for example, the ring 202 using hooks 204 with one end attached to the ring and extending outward with an ornament 206 attached at the opposing end. The end 207 of the upper spoke 190 is secured to a lower spoke 208 with a bolt 210 passing through a preformed hole in both spokes. The lower spoke 208 also supports a set of coaxial rings 211 with diameters that decrease from top to bottom. These rings include holes 212 having hooks 214 placed therethrough for hanging ornaments 206.

The top plate 194 of center piece 196 of the fixture of FIG. 9 is supported upon a center rod 216 that may be hollow and carry electrical wiring for the chandelier. The top plate 194 of the center piece 196 may be cut in the same manner as other chandelier frame parts, particularly using combined laser and punch cutting. This top plate is secured to the center rod 216 through a hole 220 in the top plate 194.

The top plate 194 is shown separately in this FIG. 10 to detail a preferred method of securing spokes to a central mounting plate according to this invention. According to this method, a pair of tabs 198 on a spoke arm 221 are positioned through corresponding slots 222 in the top plate 194 and twist locked in place.

Figure 11:
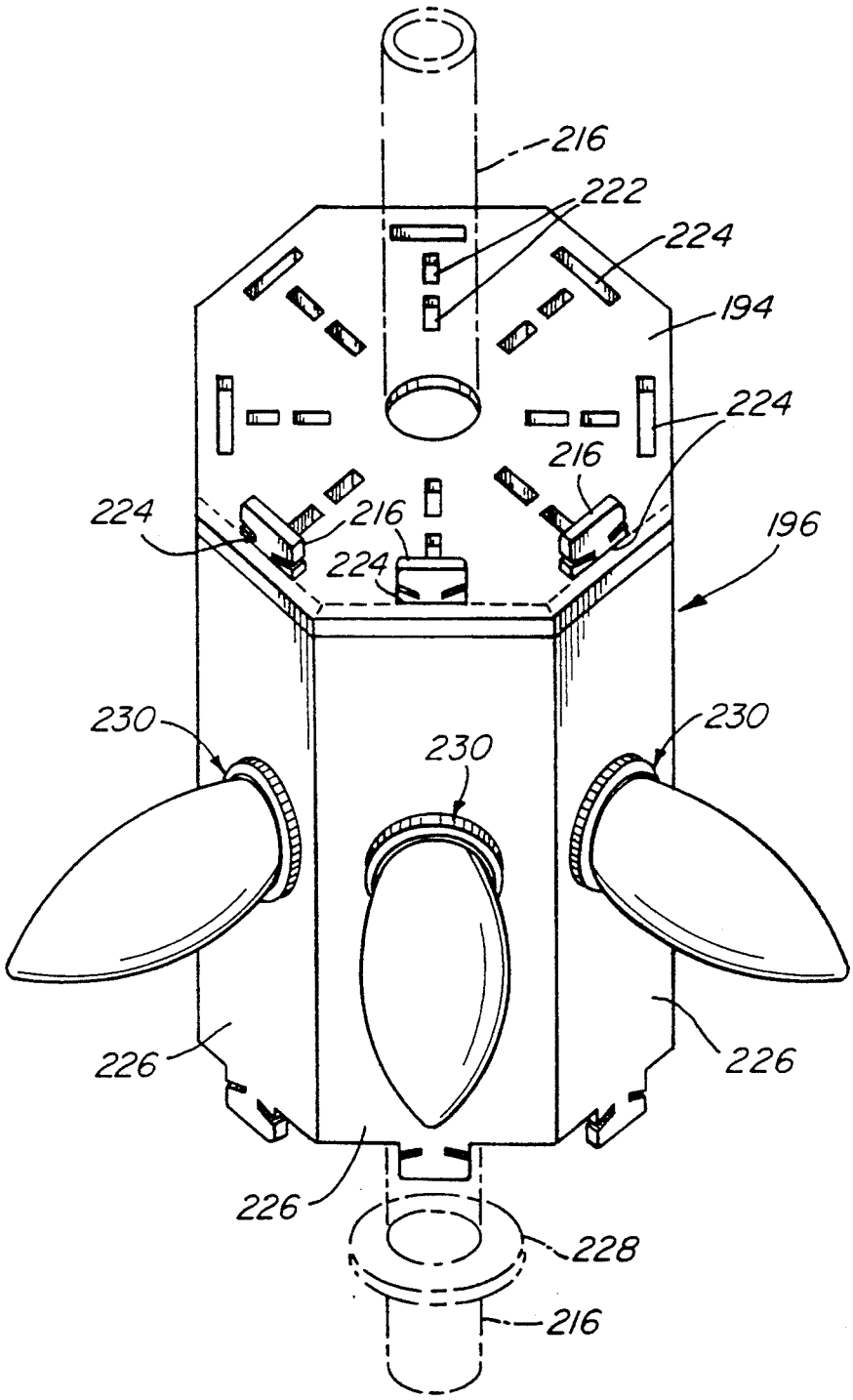
FIG. 11 is a perspective view detailing the construction of the center piece of the chandelier of FIG. 9 with spokes removed.

The top plate 194 described in FIG. 10 may form a wall of a centerpiece such as a light box. FIG. 11 details the center piece 196 with spokes removed, revealing the spoke slots 222 on the top plate 194 as previously described, and additionally, side wall slots 224 on the top plate 194. These side wall slots 224 are disposed in closer proximity to the outer edge of the top plate 194 and are transverse in elongation to the spoke slots 222. Through the side wall slots 224 in this example are located twisting tabs 216 for securing light box side walls 226. A bottom plate (not shown) may be located at the bottom of the side walls 226 and secured by a second similar set of tabs and slots to form the light box. The side walls 226 of this center piece may contain a number of light sockets 230 upon their surface for illumination of the fixture. The light sockets are connected to wires that are fed into the interior of the box through openings in the center rod 216 (not shown) in the region of the center piece interior. The center rod 216 (shown in phantom) may also have, in proximity to a bottom plate, a stop 228 to support the center piece and, consequently, the fixture as it hangs upon the rod. This stop 228 may be either machined into the rod or joined to the rod using an external joining method such as welding or screws.

Figure 13:
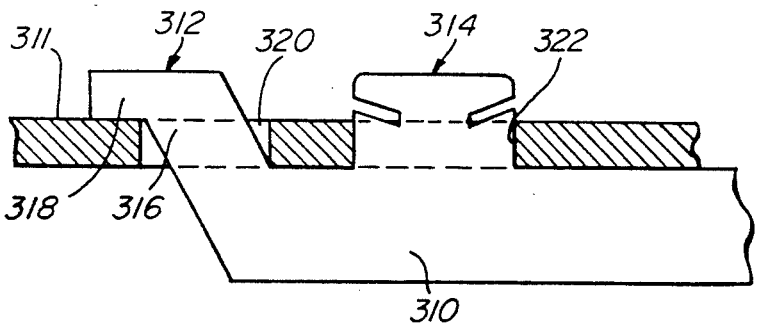
FIG. 13 is a cross-sectional view of another interlocking tab and slot arrangement according to this invention.

FIG. 13 illustrates another tab and slot arrangement according to the invention in which spoke 310 is attached to a ring 311. The spoke 310 has two upwardly facing tabs 312, 314 spaced along the length of the spoke 310, one being at the end of the spoke and the other proximate to the end. The proximately located inner tab 314 is a twist tab configured as described above in connection with FIG. 6. The end tab 312 is not a twist tab, but rather is formed of an upwardly extending segment 316 and an outwardly extending segment 318. The spoke tabs 312, 314 are interengaged with mating ring slots, an outer ring slot 320 radially aligned with an inner ring slot 322.

To attach the spoke and ring to one another, the outwardly extending segment 318 of the end tab 312 is inserted through the outer ring slot 320 with the length of the spoke oriented at an angle with respect to the ring. The spoke then is rotated toward the ring about an axis defined by the interengaging outer slot and end tab in a menner to cause the inner twist tab 314 to be introduced through the ring slot 322. The inner twist tab 314 then is twisted to lock the spoke to the ring.

As shown, the ring of embodiment of FIG. 13 rests on top of the spoke. This embodiment also is particularly useful when the inverted position is desired, that is when a ring is suspended from a spoke or when a spoke is suspended from, for example, a center washer. As stated previously, not all materials are suited to a twist tab joining technique as disclosed above. Furthermore, certain aesthetic requirements may necessitate the avoidance of twist tab covered surfaces. Therefore, an alternative system for locking rings and spokes of planar nonstressed material requiring absolutely no stressing or deformation of parts and, thus, suitable to any virtually material of sufficient rigidity is also possible according to another embodiment of the invention. In this embodiment, no twist tabs are required. This method is particularly effective where tabs may be visible and unsightly, such as in a chandelier having a largely exposed frame.

FIG. 14 depicts one such frame having a ring 240 positioned coaxially relative to a center plate or center ring 242 that carries a plurality of radially elongated through cut slots 244 disposed about its periphery. Ring slots 246 are formed upon inward facing projections of the ring 240 in radial alignment with each of the slots 244 in the center plate 242. These ring slots, of course, may be placed directly into an unprojected portion of the ring. The ring 240 is supported relative to the center plate 242 by spokes 248 extending between the two parts. Each spoke 248 has a spoke slot 250 at its outer end. The spoke slots are sized such that they interengage with the ring slots in a snug fit when the spoke is moved radially outwardly with respect to the ring. At the inwardly facing end of each spoke is a tab 252, located along a bottom edge of the spoke. When the ring slots and spoke slots are interengaged, the tabs 252 align with and may be positioned within the slots 244 in the center plate 242. The tabs 252 are sized to snugly interengage the slots 244, but, unlike the twist tab embodiment previously described, the tabs do not exit through an opposing side of the slot, nor do they have an integral locking mechanism. Rather, each spoke 248 with its tab in a slot is held forcibly in place against the center plate 242 by a locking disk 254 that engages the upper thickness edge 256 of each spoke. This disk is brought into contact with the spokes using, for example, a bolt 260 and nuts 262 and 264 located through a hole 266 in the center plate. The locking disk 254 may be concave in shape to provide additional spring force at each upper thickness edge 256.

Figure 15A:
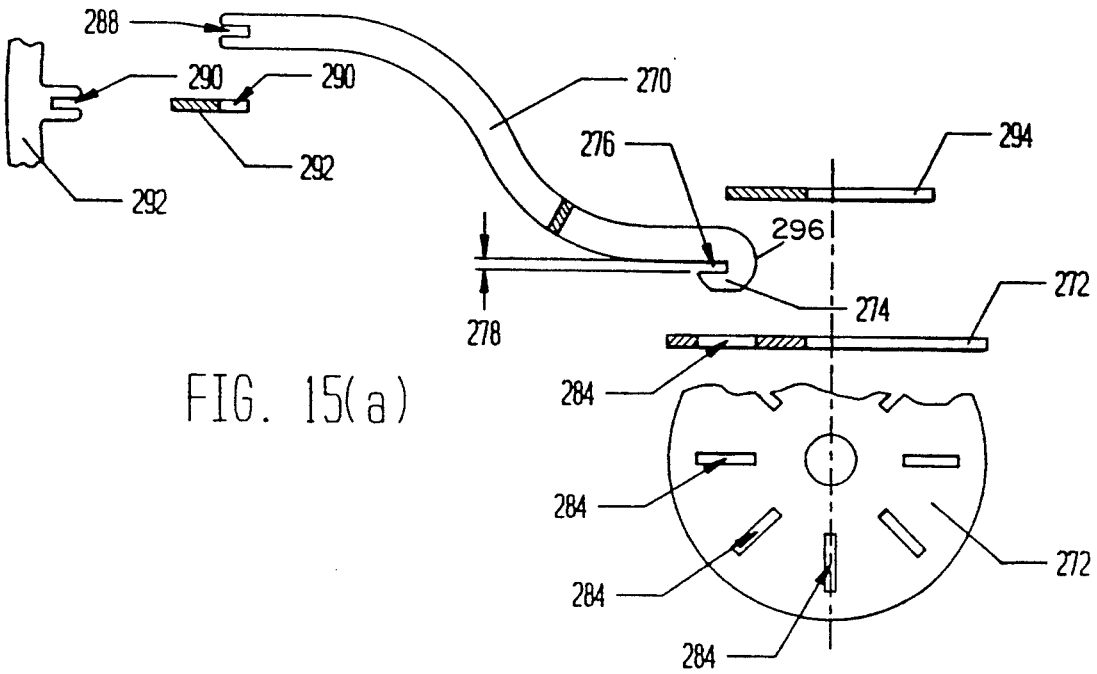
FIGS. 15(*a–b*) is a variation of the chandelier frame of FIG. 13 having a different structure for mechanically interlocking the rings and spokes.
Figure 15B:
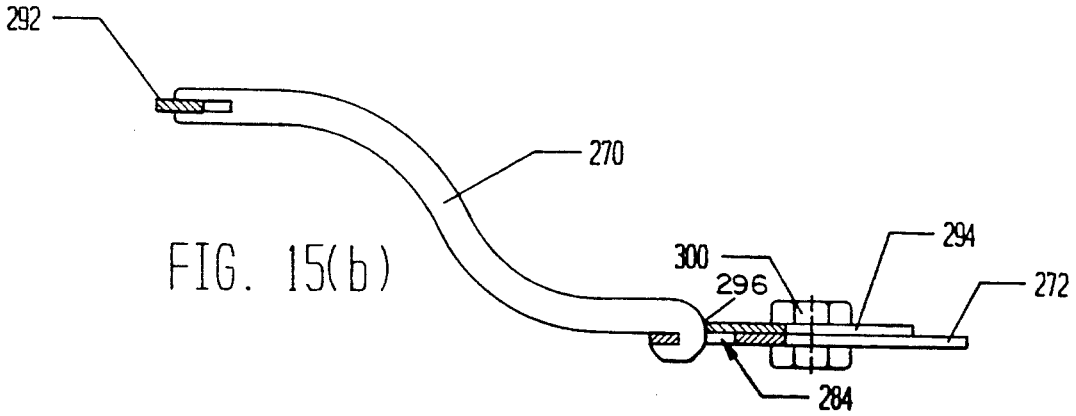

The concept of interengaging slots also may be applied to the locking of the spokes to the center plate. An example of this configuration is shown in FIG. 15(*a*) which depicts a spoke 270 and center plate 272 similar in configuration to those shown in FIG. 13, except that the inner end of the spoke 270 is formed with a lower projection 274 defining a slot 276 with a slot width 278 approximately equal to the thickness of the center plate. The projection 274 is sized to fit through the plate slots 284. Once passed into the slot, as shown in FIG. 15(*b*), the spoke is slid radially outwardly to firmly interengage the outer spoke slot 288 with the slot 290 of a ring 292 and to simultaneously interengage the slot of the projection 274 with the plate slot 284. In this interengaged position, a flat locking disk 294 is then positioned on the surface of the center plate 272 where it rests snugly against the inwardly facing side edges 296 of the spokes. The locking disk 294 may be secured as shown, in this example in FIG. 15(*b*), by a bolt assembly 300 through a hole in the center of the locking disk and center plate.

The planar nonstressed pieces utilized in this invention may be composed of a variety of materials including sheet metals like steel, brass and aluminum. In one preferred embodiment, the parts of the frame are composed of sheet steel having a sufficient thickness to prevent buckling and bending under the weight of the frame and ornaments. Steel generally has the advantage in that it does not wear easily reducing potential loosening of locked surfaces, and it remains twistably deformed in place if twisted tabs are employed. Stainless steel has the advantage of increased structural strength and is a noncorroding material requiring no finishing process. Steel having a hardness of Rockwell scale 90B has been used successfully according to the invention.

The chandelier frame may alternatively be constructed of high strength plastic or acrylic, either clear or with coloring, that has the advantages of certain decorative value, reducing the cost of the finished chandelier, and particularly enabling effective snap fit locking of parts. Plastics also allow effective adhesion of parts through chemical, heat or ultrasonic welding. Such bonding may be accomplished after the component parts have been substantially assembled and symetrically aligned.

As described above, the nonstressed materials utilized to construct parts of a chandelier frame according to this invention may be formed and cut very precisely using a laser cutter. A preferred type of laser cutter is a combination turret punch press/laser cutter. Such a machine is employed regularly in the sheet metal industry. The Strippet model F/C 1250-30-1500 made by Strippet Co. of Akron, N.Y. fitted with a Rofin Sinar 1200 watt $CO_2$ laser, for example, provides sufficient capabilities for large scale production of chandelier frame parts according to this invention. Cuts may be made entirely by laser, but repetitive shaped cuts may also be made by a punch. This unit includes a mechanical punch press for repetitive shape cuts, such as slots and blank tabs. The punch press develops up to 30 tons of punching force. The table of this unit may accommodate up to 5 foot by 10 foot sheet material pieces with up to 60×60″ of travel under programmed computer numerical control. The punch includes turret tooling that accommodates up to 33, differently shaped punches that may be brought into ready position as necessary under programmed control. Since curved shapes may often by encountered, the unit should be equipped with stations that allow the punch to be rotated under computer numerical control. This allows slots and other shapes to be rotatably disposed around a circumference at will. Actual programming of the unit is accomplished using an X-Y axis positioning software program that may be loaded onto virtually any standard micro computer.

The design of a chandelier may be accomplished entirely on a computer using a computer-aided design program with virtually no margin of error in the dimensions of parts. This computer design can then be converted to numerical X-Y coordinate data that is directly loaded into the laser cutter control program to produce the finished chandelier frame parts. Thus, a full, complex chandelier may be constructed as a one-off unique model with only the design costs as an additional expense. Such a chandelier would be impossible to build using traditional mass production techniques. The flat pattern cuts required lend themselves to an automated cutting methods with or without lasers. The structure of a chandelier frame according to this invention, similarly, lends itself to quick assembly even while pieces are in the process of cutting.

Figure 16:
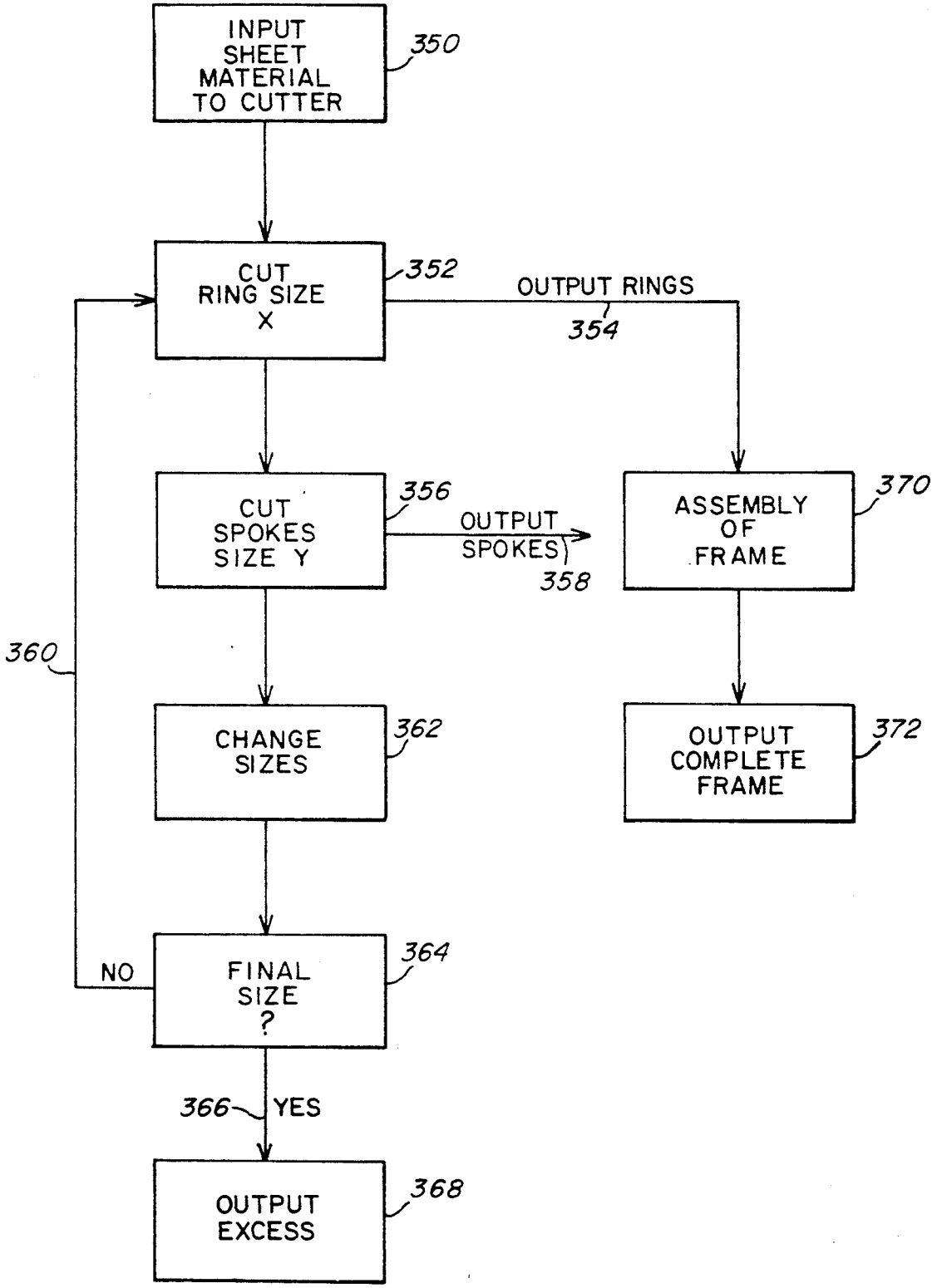
FIG. 16 is a flow chart of a construction process of a chandelier frame according to this invention.

FIG. 16 depicts an example of a flow chart for assembly of a chandelier frame. The process is initialized with the input 350 of a sheet of nonstressed material to the cutting device. A ring, including slots and ornament holes, is cut to a predetermined size 352. This ring is then output 354 to an assembly area. The sheet then is input to a second cutter that cuts 356 and outputs 358 spokes of predetermined sizes to an assembly area. Since no welds or other adhesives are used that would slow the process, assembly of spokes to each output ring can occur at once by simply fitting the parts together and twisting the appropriate tabs in place using, for example, an ordinary pair of pliers. An additional advantage of the simple assembly made possible with these frames is that significantly less skill is required, thus, lowering labor costs.

The cutting and outputting process continues 360 with the ring and spoke size changes 362 until the system determines 364 that the final cutting operation has been performed 366. Note in FIG. 8 how each ring may fit completely within the next larger ring, thus, allowing all rings to be cut concentrically. The system may output 368 any remaining excess sheet material. As each component part is output to the assembly area, it is, in turn, assembled 370 by twisting tabs or other quick assembly method to spokes or other output parts until a finished chandelier frame is formed 372. This finished frame may then have ornaments applied at a separate station. It is important to note that even if assembly requires the use of some adhesive or weld, this invention allows precise alignment of all parts prior to the welding or adhesive operation, thus significantly increasing the speed and accuracy of assembly. All joints can be assembled and then all welds can be applied in an "assembly line" manner rather than one piece carefully fitted at a time.

Figure 17:
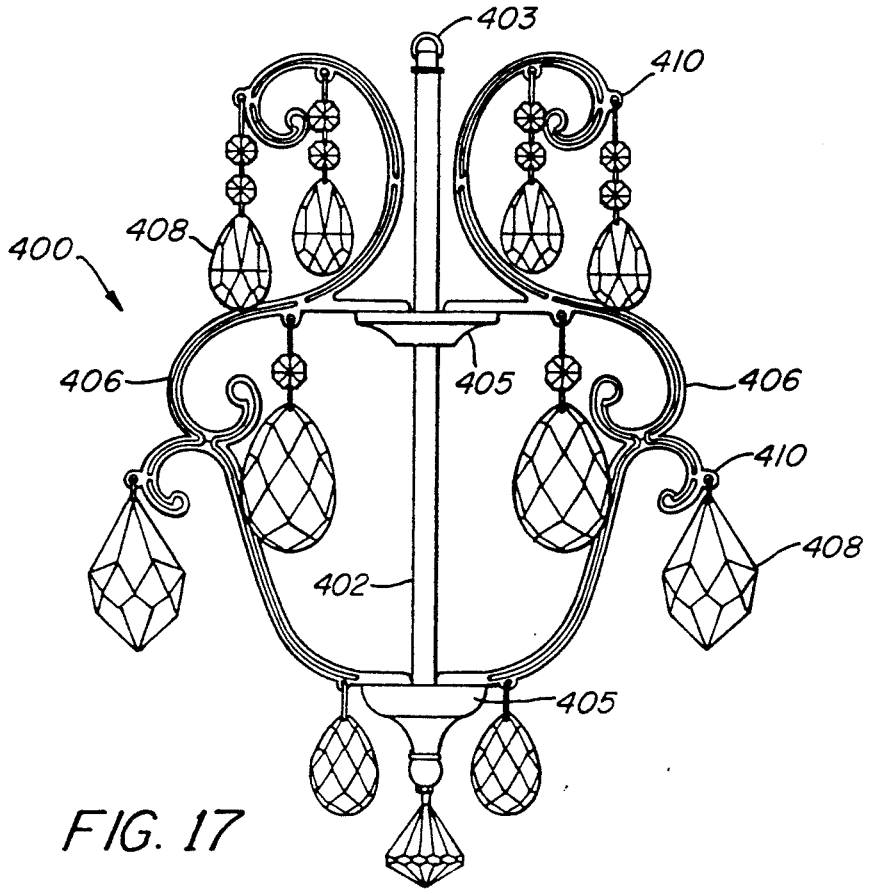
FIG. 17 is a perspective view of a portion of another embodiment of the invention.
Figure 18:
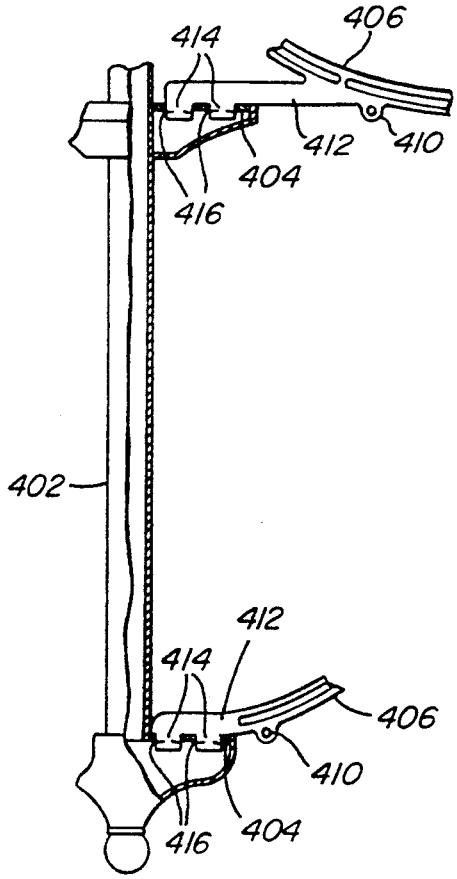
FIG. 18 is an enlarged cross-sectional view of a portion of the chandelier of FIG. 17 showing the interengagement of the spokes with the rings.

FIGS. 17 and 18 depict another chandelier according to the invention. In this embodiment, the rings are not adapted for carrying ornaments, but rather are disposed centrally of the array of scrolled spokes for precisely aligning and supporting the array of scrolled spokes.

Referring to FIG. 17, the chandelier 400 has a central stem 402 with an attachment ring 403 for supporting the chandelier from the ceiling. Attached to the stem 402 and spaced apart from one another are a pair of disk-shaped plates or rings 404 (obscured in FIG. 17 by covers 405). These rings or plates are similar to those described above in connection with FIGS. 10, 14 and 15. Attached to and extending radially from the rings 404 are an array of scrolled spokes 406. (Only two spokes are shown for the purpose of clarity.) Ornaments 408 are attached to the scrolled spokes via openings 410 in the scrolled spokes.

The scrolled spokes 406 are attached to the rings 404 via the tab and slot arrangement (FIG. 18) described above. The scrolled spokes 406 include arm portions 412 extending radially inwardly for attachment to the rings 404. The arms carry a pair of integrally formed tabs 414 which project through slots 416 in the ring 404. The tabs 414 are twisted to provide positive locking interengagement between the rings 404 and scrolled spokes 406.

It should be understood that the preceding is merely a detailed description of a preferred embodiment. It should be apparent to those skilled in the art that various modifications and equivalents can be made without departing from the spirit or scope of the invention. The preceding description is meant to describe only a preferred embodiment and not to limit the scope of the invention.

What is claimed is:

1. A chandelier frame comprising, rings adapted for supporting ornaments, each ring having a flat surface, spokes attached to the rings for supporting the rings, each spoke having a flat surface and a thickness transverse to the flat surface, the flat surface defining a width that is substantially greater than the thickness, and wherein the flat surfaces of the coaxial rings define first parallel planes and the flat surfaces of the spokes define second planes substantially perpendicular to the first planes and wherein the spokes define along a length of the surface transverse to their flat surfaces and facing the rings at least three nonlinear segments, mechanical interengagement means associated with the rings and spokes for aligning the rings and spokes with respect to one another, and locking means mechanically and detachably locking the rings and spokes against disengagement from one another.

2. A chandelier frame as claimed in claim 1 wherein the mechanical interengagement means is preformed and is located at discrete positions on the rings and spokes to precisely align the rings both axially and radially with respect to one another.

3. A chandelier frame as claimed in claim 2 wherein the locking means includes slots in radial projections on the rings.

4. A chandelier frame as claimed in claim 2 wherein the rings include openings for supporting a plurality of ornaments and wherein the rings are supported coaxially.

5. A chandelier frame as claimed in claim 2 wherein the mechanical interengagement means comprises interengaging tabs and slots associated with the rings and spokes.

6. A chandelier frame as claimed in claim 5 wherein the locking means comprises a portion of each tab twisted into an engagement with at least one surface adjacent its corresponding slot.

7. A chandelier frame as claimed in claim 5 wherein the tab has a head and a neck, and wherein the neck has a narrower diameter than the head.

8. A chandelier frame as claimed in claim 5 wherein the mechanical interengagement means comprises a pair of adjacent, radially-aligned tabs interengaging a pair of slots.

9. A chandelier frame as claimed in claim 5 wherein the tabs have tab slots that extend into the slots associated with the rings and spokes.

10. A chandelier frame as claimed in claim 5 wherein the slot is a through-cut slot.

11. A chandelier frame as claimed in any one of claims 1, 2, 3, 5, 6, 7, 8, 9 or 10 wherein each spoke has a main segment and a plurality of arm segments integral with and extending from the main segment and defining platforms for attachment to the rings.

12. A chandelier frame as claimed in any one of claims 1, 2, 3, 5, 6, 7, 8, 9 or 10 wherein the spokes and rings are substantially nonstressed.

13. A chandelier frame as claimed in any one of claims 1, 2, 3, 5, 6, 7, 8, 9 or 10 further comprising a light box located substantially centrally of the chandelier frame and attached to spokes by interengaging locking means for mechanically securing the box to the spokes.

14. A chandelier frame as claimed in any one of claims 1, 2, 3, 5, 6, 7, 8, 9 or 10 further comprising a ring centrally and axially disposed with respect to the spokes and mechanically and detachably secured to the spokes.

15. A chandelier frame comprising, a plurality of rings including openings for supporting ornaments, spokes attached to the rings for supporting the rings coaxially in parallel planes, wherein the overall radial and axial tolerance of the rings with respect to themselves and one another in the assembled frame is less than 3/64 of an inch.

16. A chandelier frame as claimed in claim 15 wherein the rings and spokes prior to their attachment to one another to form the chandelier frame are substantially nonstressed.

17. A chandelier frame as claimed in any one of claims 15 and 16 wherein at least one spoke defines ring attachment platforms spaced axially apart and oriented in parallel relationship.

18. A chandelier frame as claimed in claim 14 wherein all of the rings include mechanical attachment means for securing the rings to the spokes, the means radially aligned among the rings and positioned at predetermined locations with respect to ornament attachment openings in the rings.

19. A chandelier frame as claimed in claim 17 wherein all of the rings include mechanical attachment means for securing the rings to the spokes, the means radially aligned among the rings and positioned at a predetermined location with respect to ornament attachment openings in the rings.

20. A method for constructing the parts for a chandelier frame comprising, cutting rings for supporting ornaments from flat sheet material, and cutting spokes for supporting the rings from flat sheet material, characterized in that the rings and the spokes are cut in a manner such that they include mechanical interengagement means for aligning the rings to the spokes and also such that they include locking means for mechanically and detachably locking the rings and spokes against disengagement from one another.

21. A method as claimed in claim 20 further characterized by forming a slot in one of the rings and spokes and cutting a mating tab in the other of the rings and spokes for properly positioning the rings and spokes with respect to one another in the assembled chandelier frame, the frame tab being sized for insertion through the slot.

22. A method as claimed in claim 20 further characterized by laser cutting at least a portion of one of said slot or tab.

23. A method as claimed in claim 20 wherein the tab is cut in a manner such that it has a head and a neck, and wherein the neck defines a narrower diameter relative to the head.

24. A method as claimed in claim 20 wherein the tab is cut in a manner such that it extends from a platform.

25. In a chandelier of the type including a plurality of rings attached to a plurality of spokes, the improvement comprising interengaging tabs and slots associated with the rings and spokes for mechanically securing the rings to the spokes, wherein the tabs extend through the slots from a platform and wherein each tab is twisted into positive locking engagement with surfaces adjacent its respective slot.

26. The improvement of claim 25 wherein each tab has a head and a neck, the neck defining a narrower diameter relative to the head.

27. The improvement of claim 25 wherein an axis is defined centrally of each tab in the direction of that tab passing through its respective slot and wherein each tab is twisted by rotation of a portion of each tab about its axis.

28. The improvement of claim 26 wherein the tabs have tab slots that extend into the slots associated with the rings and spokes, the tab slots defining the neck.

29. In a chandelier of the type including a plurality of rings attached to a plurality of spokes, the improvement comprising interengaging tabs and slots associated with the rings and spokes for mechanically securing the rings to the spokes, wherein a pair of adjacent tabs is associated with a pair of adjacent slots, and wherein at least one of the tabs is a twisted tab.

* * * * *